US008104304B2

(12) United States Patent
Kang et al.

(10) Patent No.: US 8,104,304 B2
(45) Date of Patent: Jan. 31, 2012

(54) ICE MAKING DEVICE FOR REFRIGERATOR

(75) Inventors: Byeong-Gyu Kang, Gyeongsangnam-do (KR); Young-Woo Kim, Gimhae-si (KR); Jae-Youl Lee, Gimhae-si (KR); Hwal-Kyun Lee, Busan (KR); Jong-Seok Yoon, Pyeongtaek-si (KR); Sang-Ho Park, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 727 days.

(21) Appl. No.: 12/294,828

(22) PCT Filed: Jun. 13, 2007

(86) PCT No.: PCT/KR2007/002834

§ 371 (c)(1), (2), (4) Date: Sep. 26, 2008

(87) PCT Pub. No.: WO2008/002023

PCT Pub. Date: Jan. 3, 2008

(65) Prior Publication Data

US 2010/0236273 A1 Sep. 23, 2010

(30) Foreign Application Priority Data

| | | |
|---|---|---|
| Jun. 29, 2006 | (KR) | 10-2006-0059677 |
| Aug. 4, 2006 | (KR) | 10-2006-0073922 |
| Sep. 18, 2006 | (KR) | 10-2006-0090249 |
| Sep. 18, 2006 | (KR) | 10-2006-0090250 |
| Sep. 18, 2006 | (KR) | 10-2006-0090251 |

(51) Int. Cl.
*F25C 5/18* (2006.01)

(52) U.S. Cl. ..... 62/344; 62/345

(58) Field of Classification Search ..... 62/66, 71, 62/344, 345, 347
See application file for complete search history.

(56) References Cited

U.S. PATENT DOCUMENTS

| | | | | |
|---|---|---|---|---|
| 917,036 | A | 4/1909 | Folden | |
| 2,212,405 | A | 8/1940 | Rose et al. | |
| 2,429,882 | A | 10/1947 | Jennings et al. | |
| 3,188,827 | A | 6/1965 | Bauerlein | |
| 4,432,529 | A * | 2/1984 | McMillan | 249/52 |
| 4,817,827 | A | 4/1989 | Kito et al. | |
| 4,852,359 | A | 8/1989 | Manzotti | |

(Continued)

FOREIGN PATENT DOCUMENTS

| | | | |
|---|---|---|---|
| JP | 5-164440 | A | 6/1993 |

(Continued)

*Primary Examiner* — Mohammad Ali
(74) *Attorney, Agent, or Firm* — Birch, Stewart, Kolasch & Birch, LLP

(57) ABSTRACT

The present invention relates to an ice-making device for a refrigerator. The ice-making device of the present invention comprises a water tank detachably installed to a rear surface of a refrigerator door for selectively opening or closing a storage space, first and second ice trays rotatably installed to the rear surface of the door to make ice using water supplied from the water tank, and an ice bank installed to the rear surface of the door to store therein the ice made in the first and second ice trays. According to the present invention, ice can be more simply and easily taken out while minimizing the leakage of cold air circulating in the storage space. Further, ice can be stored in a more sanitary way while minimizing the contamination of the storage space in the process of making ice.

34 Claims, 12 Drawing Sheets

U.S. PATENT DOCUMENTS

| | | | | |
|---|---|---|---|---|
| 5,012,655 | A | 5/1991 | Chatterton | |
| 5,177,980 | A * | 1/1993 | Kawamoto et al. | 62/353 |
| 5,263,334 | A | 11/1993 | Kado et al. | |
| 5,297,394 | A * | 3/1994 | Frohbieter et al. | 62/135 |
| 5,829,266 | A | 11/1998 | Lyu | |
| 5,971,213 | A * | 10/1999 | Lee | 222/146.6 |
| 6,938,428 | B2 | 9/2005 | Onishi et al. | |
| 6,973,803 | B2 * | 12/2005 | Olive et al. | 62/338 |
| 7,318,323 | B2 * | 1/2008 | Tatsui et al. | 62/320 |
| 2005/0210909 | A1 * | 9/2005 | Kim et al. | 62/340 |
| 2005/0241329 | A1 | 11/2005 | Castrellon et al. | |
| 2006/0065008 | A1 | 3/2006 | Park | |

FOREIGN PATENT DOCUMENTS

| | | | |
|---|---|---|---|
| KR | 10-0202064 | B1 | 3/1999 |
| KR | 10-0221147 | B1 | 6/1999 |
| KR | 2000-0027232 | A | 5/2000 |
| KR | 10-2005-0033295 | A | 4/2005 |
| KR | 10-2005-0110213 | A | 11/2005 |
| WO | WO-2005/026831 | A1 | 3/2005 |

* cited by examiner

ICE MAKING DEVICE FOR REFRIGERATOR

TECHNICAL FIELD

The present invention relates to a refrigerator, and more particularly, to an ice-making device for a refrigerator.

BACKGROUND ART

Refrigerators are household appliances for keeping foods refrigerated or frozen to store the foods in a fresh state for a long time. The interior of the refrigerator is partitioned into freezing and refrigerating chambers, and an ice-making device is detachably provided in the freezing chamber.

FIG. 1 is a front view showing the interior of a refrigerator provided with a conventional ice-making device, and FIG. 2 is a plan view showing the ice-making device provided in the refrigerator shown in FIG. 1.

As shown in these figures, freezing and refrigerating chambers 11 and 13 which are vertically partitioned are provided within a main body 10 of a refrigerator. The main body 10 is provided with a freezing chamber door 11D and a refrigerating chamber door 13D in order to selectively open or close the freezing and refrigerating chambers 11 and 13, respectively. Each of the freezing and refrigerating chamber doors 11D and 13D is hinged along a lateral side of the main body 10.

A plurality of shelves 15 and 17 are detachably installed within the freezing and refrigerating chambers 11 and 13. The freezing and refrigerating chambers 11 and 13 are vertically divided by the shelves 15 and 17, respectively. A pair of vegetable boxes 19 are retractably installed at a lower portion of the refrigerating chamber 13. Foods such as vegetable are stored in the vegetable boxes 19.

Furthermore, an ice-making device 21 is installed at one side of an upper portion of the freezing chamber 11. The ice-making device 21 is used to make ice. As shown in FIG. 2, the ice-making device 21 is retractably installed within the freezing chamber 11. Further, the ice-making device 21 is composed of a support frame 23 and a pair of ice trays 25.

The support frame 23 is formed in a rectangular frame shape. Each of the ice trays 25 is formed with a plurality of ice-making grooves 25A. Support shafts 26 are provided at the centers of front and rear surfaces of the ice trays 25, respectively. The ice tray 25 is supported on the support frame 23 such that it can be rotated clockwise or counterclockwise about the support shaft 26 as viewed in FIG. 2. To this end, the support shaft 26 is rotatably inserted into the rear surface of the support frame 23.

A stopper 27 is provided to protrude from the rear surface of the support frame 23 at a certain position thereof corresponding to the left side of the support shaft 26 as viewed in FIG. 2. The stopper 27 allows a leading end of the ice tray 27 to be twisted with respect to a trailing end of the ice tray 25 rotating about the support shaft 26.

A pair of levers 28 are provided on a front surface of the support frame 23 corresponding to the front side of the ice tray 25. The lever 28 is a portion which a user grips to rotate the ice tray 25. The lever 28 is connected to the support shaft 26 provided at the front surface of the ice tray 25.

Referring again to FIG. 1, an ice bank 29 is installed below the ice-making device 21 within the freezing chamber 11. Ice made in the ice-making device 21 is stored in the ice bank 29. The ice bank 29 is also retractably installed within the freezing chamber 11.

A process of making ice using the ice-making device configured as such will be explained as follows.

First, the ice-making grooves 25A of the ice tray 25 are filled with water. The freezing chamber door 11D is opened to put the ice-making device 21 into a predetermined position in the freezing chamber 11. After the ice-making device 21 has been put into the freezing chamber 11 in such a way, the freezing chamber door 11D is closed to close the freezing chamber 11.

Meanwhile, if the water filled in the ice-making grooves 25A is frozen after a certain period of time, the freezing chamber door 11D is again opened to open the freezing chamber 11. If the lever 28 is rotated clockwise as viewed in FIG. 2, the ice tray 25 is twisted. Therefore, the ice made in the ice-making grooves 25A is separated from the ice tray 25 and then stored in the ice bank 29.

However, the conventional ice-making device for a refrigerator has the following problems.

If a user wishes to withdraw the ice bank 29, in which ice made in the ice tray 25 is stored, out of the freezing chamber 11, he/she should pull the freezing chamber door 11D to open the freezing chamber 11. Thus, it is troublesome to put the ice bank 27 into or out of the freezing chamber.

Moreover, when the freezing chamber 11 is opened to withdraw the ice bank 29 out of the freezing chamber, cold air in the freezing chamber 11 is discharged to the outside. That is, in the conventional ice-making device for a refrigerator, cold air in the freezing chamber 11 is unnecessarily discharged to the outside while the ice bank 29 is withdrawn out of the refrigerator. Thus, power consumption of the refrigerator is increased.

Further, the ice bank 29 is accommodated in the freezing chamber 11. Thus, it is likely that ice stored in the ice bank 29 is impregnated with odor of other foods stored in the freezing chamber 11.

Furthermore, in the conventional ice-making device for a refrigerator, water filled in the ice-making grooves 25A of the ice tray 25 is frozen into ice, after a predetermined period of time, due to cold air circulating in the freezing chamber 11. That is, water filled in the ice-making grooves 25A of the ice tray 25 may be splashed out of the grooves due to impact generated when the freezing chamber door 11D is opened or closed. Therefore, the freezing chamber 11 may be contaminated by the splashed water.

DISCLOSURE

Technical Problem

Accordingly, the present invention is conceived to solve the problems in the prior art. An object of the present invention is to provide an ice-making device for a refrigerator capable of withdrawing ice in a simpler way.

Another object of the present invention is to provide an ice-making device for a refrigerator capable of minimizing loss of cold air circulating in a storage space when ice is taken out.

A further object of the present invention is to provide an ice-making device for a refrigerator capable of preventing ice stored in an ice bank from being impregnated with odor of other foods.

A still further object of the present invention is to provide an ice-making device for a refrigerator capable of minimizing contamination in the refrigerator in the process of making ice.

Technical Solution

According to an aspect of the present invention for achieving the objects, there is provided an ice-making device for a refrigerator comprising a water tank detachably installed to a rear surface of a refrigerator door for selectively opening or closing a storage space, first and second ice trays rotatably installed to the rear surface of the door to make ice using water supplied from the water tank, and an ice bank installed to the rear surface of the door to store therein the ice made in the ice trays.

The water tank may be divided into first and second water storage spaces from which water is supplied to the first and second ice trays, respectively.

The water stored in the first and second water storage spaces may be supplied simultaneously to the first and second ice trays, respectively, by means of a valve assembly actuated when the water tank is mounted to the rear surface of the door.

The ice-making device of the present invention may further comprise a water supply means for supplying water stored in any one of the first and second water storage spaces into one of the first and second ice trays positioned relatively lower than the other of the first and second ice trays installed to the rear surface of the door such that the ice trays are spaced apart from each other by predetermined distances both in a horizontal direction and in a front or rear direction.

The water supply means may comprise a water supply hopper installed just below the water tank to receive water from any one of the first and second water storages spaces of the water tank, and a water supply tube including one end connected to a lower portion of the water supply hopper and the other end positioned just above the lower ice tray to allow the water supplied into the water supply hopper to be delivered to the lower ice tray.

Preferably, the water supply tube is formed of a flexible material.

The water supply means may comprise a water supply hopper installed just below the water tank to receive water from any one of the first and second water storages spaces of the water tank, and a water supply tube installed below a lower portion of the water supply hopper to supply water to the predetermined ice tray and formed with a protruding end guide.

The water supply tube may be formed such that its distal end is inclined at an acute angle relative to an extension direction of the water supply tube.

The ice-making device of the present invention may further comprise an ice-making housing installed to the rear surface of the door and provided with an installation space in which the water tank, the first and second ice trays and the ice bank are installed.

The ice-making device of the present invention may further comprise a housing cover for covering the installation space of the ice-making housing in a state where the water tank is installed at an upper portion of the installation space of the ice-making housing.

The housing cover may be formed integrally with a top surface of the water tank.

According to another aspect of the present invention, there is provided an ice-making device for a refrigerator comprising a water tank detachably installed to a rear surface of a refrigerator door for selectively opening or closing a storage space, first and second ice trays rotatably installed to the rear surface of the door to make ice using water supplied from the water tank, and a rotating means installed to the rear surface of the door to simultaneously rotate the first and second ice trays such that the first and second ice trays can be twisted to separate the made ice from the first and second ice trays.

The rotating means may comprise a first gear connected with any one of a pair of rotating shafts for allowing the first ice tray to be rotatably supported on the rear surface of the door, a second gear connected with any one of a pair of rotating shafts for allowing the second ice tray to be rotatably supported on the rear surface of the door, and at least one linking gear engaged with the first and second gears.

The rotating means may further comprise a lever fixed to the linking gear such that a user can grip the lever to rotate the first and second ice trays.

The lever may include a connection portion having one end connected to any one of the first and second gears and the linking gear, and a grip portion connected to the other end of the connection portion such that the user can grip the grip portion to rotate the first and second ice trays.

The rotating means may further comprise an elastic member for allowing the first and second gears and the linking gear to impart an elastic force to the first or second ice tray in a direction opposite to a direction in which the first or second ice tray is rotated to separate ice from the tray.

Each of the first and second ice trays may be formed to have a rectangular cross section and is rotated about rotating shafts provided at opposite side surfaces thereof.

The first or second ice tray may be maintained at a horizontal state by means of a tray stopper provided on the rear surface of the door and be twisted by a force required to pivot the first or second ice tray in a state where a portion of the ice tray is brought into close contact with the tray stopper after the tray has been rotated by a predetermined angle of rotation.

Preferably, a guide protrusion is provided on any one of the opposite surfaces of the first or second ice tray to be spaced apart from the rotating shaft by a predetermined distance, a guide slot is formed into an arc shape having a predetermined central angle about the rotating shaft of the first or second ice tray and is formed at the rear surface of the door to allow the guide protrusion to be inserted therein, and the guide protrusion is moved from one end of the guide slot to the other end of the slot as the first or second ice tray is rotated about the rotating shaft.

The first or second ice tray may further comprise a first or second tray cover for preventing water stored in the water tank from being splashed to the outside of the ice tray while the water is supplied into the first or second ice tray.

The tray cover may include a tray cover main body formed into a rectangular shape corresponding to an upper surface of the ice tray and provided with a water supply port, through which water delivered from water tank is supplied into the ice tray, at the center thereof, and a guide rib extending downwardly from an outer periphery on a lower surface of the tray main body and having a leading end of the contact rib brought into close contact with an upper edge of the first or second ice tray.

The tray cover may be installed such that any one of both ends of the tray cover parallel to the rotating shaft, which allows the ice tray to be rotatably supported on the rear surface of the door, is pivoted on the other end of the tray cover in a direction opposite to a rotating direction of the ice tray as the ice tray is rotated to separate ice from the ice tray.

The pivoting end of the ice tray cover may be brought into close contact with the guide stopper provided on the rear surface of the door to allow the pivot end to be relatively pivoted on the other end of the tray cover with respect to the ice tray in a direction opposite to the rotating direction of the ice tray to separate the ice from the ice tray.

The ice-making device of the present invention may further comprise an ice-making housing installed to the rear surface of the door and provided with an installation space in which the water tank, the first and second ice trays, the rotating means and the first and second tray covers are installed.

According to a further aspect of the present invention, there is provided an ice-making device for a refrigerator comprising first and second ice trays rotatably installed to a rear surface of a refrigerator door for selectively opening or closing a storage space to make ice using supplied water, and an ice bank installed to be received in or withdrawn from an opening formed by cutting out a portion of a front surface of the door and to store therein the ice made in the ice trays.

The ice bank may be installed to be received in or withdrawn from an installation space defined within the ice-making housing detachably installed to the rear surface of the door.

The ice bank may be received or withdrawn in a front direction of the door through the opening and a first ice bank entrance formed in a rear surface of the ice-making housing brought into close contact with the rear surface of the door and be received or withdrawn in a rear direction of the door through the a second ice bank entrance formed in a front surface of the ice-making housing parallel to the rear surface of the door.

The ice-making device of the present invention may further comprise a cooperating means for allowing the ice bank to be received in or withdrawn from the installation space of the ice-making housing in accordance with a pivot motion of a home bar door installed at a potion on a front surface of the door such that an upper end of the home bar door is vertically pivoted on a lower end of the home bar door to selectively open or close the opening.

The cooperating means may include a seating plate installed to be movable in or out of the installation space of the ice-making housing to allow the ice bank to be securely placed thereon, and a cooperating plate formed with a rear end pivotally connected to a front end of the seating plate and a front end fixed to a rear surface of the home bar door such that the ice bank is received in or withdrawn from the installation space of the ice-making housing as the home bar door is pivoted.

Preferably, at least one movement prevention protrusion and at least one movement prevention groove are formed on a bottom surface of the ice bank and a top surface of the seating plate, respectively, such that the protrusion is inserted in the groove to prevent the protrusion and the groove from being inadvertently moved relative to each other in a state where the ice bank is securely placed on the top surface of the seating plate while the seating plate is moved in or out of the installation space.

At least one water drain hole may be formed in the seating plate to allow water residing between the bottom surface of the ice bank and the top surface of the seating plate to drain downwardly.

Each lateral side of the seating plate may be provided with at least one movable roller which is moved along a floor surface of the ice-making housing while the seating plate is moved in or out of the installation space of the ice-making housing as the home bar door is pivoted.

Each of front and rear ends of the ice bank may be provided with a gripping recess which a user grips to allow the ice bank to be received in or withdrawn from the ice-making housing.

Preferably, the gripping recess may be formed by upwardly depressing a portion of the front or rear end of the ice bank, and a gripping opening is provided at a front or rear end of the seating plate by cutting out a portion of the seating plate to correspond to a cross section of the gripping recess such that a user can easily grip the gripping recess.

According to a still further aspect of the present invention, there is provided an ice-making device for a refrigerator comprising an ice-making housing installed to a rear surface of a refrigerator door for selectively opening or closing a storage space and provided with a predetermined installation space, a water tank detachably installed to the installation space of the ice-making housing, first and second ice trays rotatably installed to the installation space of the ice-making housing to make ice using water supplied from the water tank, an ice bank retractably installed in the installation space of the ice-making housing to store therein the ice made in the first and second ice trays, and a mounting means for detachably mounting the ice-making housing to the rear surface of the door.

The mounting means may include at least one mounting protrusion formed on an inner surface of a ridged portion extending vertically at and protruding rearward from a side end of the rear surface of the door, at least one seating groove formed in one side surface of the ice-making housing to allow the mounting protrusion of the ridged portion to be fitted therein, at least one mounting protrusion formed on the other side of the ice-making housing, and at least one mounting groove formed in one side surface of a door basket detachably installed to the rear surface of the door to allow the mounting protrusion of the ice-making housing to be fitted therein.

The ice-making housing may include a first ice-making housing detachably installed to the rear surface of the door and provided with a first installation space in which the water tank and the ice bank are installed, and a second ice-making housing detachably installed in the first installation space of the first ice-making housing and provided with a second installation space in which the first and second ice trays and the rotating means are installed.

The mounting protrusion fitted in the mounting groove of the door basket may be provided on one side surface of the first ice-making housing, and the mounting groove in which the mounting protrusion of the ridged portion is fitted may be provided on one side surface of the second ice-making housing.

Preferably, a recess in which a seating step that extends in a horizontal direction along the rear surface of the door and protrudes backward from the rear surface of the door to support the door basket is inserted is formed on a rear outer surface of the second ice-making housing.

A viewing window for visually checking whether ice is made in the first and second ice trays and at least one cold air supply port for supplying the first and second ice trays with cold air circulating in the storage space may be provided on one side of the second ice-making housing.

Advantageous Effects

According to the present invention, the ice bank with ice stored therein can be conveniently received in or withdrawn out of the refrigerator through an operation of opening or closing the home bar door. Therefore, a user can easily take ice out of the refrigerator.

Further, the ice bank with ice stored therein can be received in or withdrawn out of the refrigerator by opening only the home bar door without opening the refrigerator door. Therefore, an amount of cold air circulating in the storage space of the refrigerator to be lost to the outside is minimized, so that the refrigerator can be utilized more economically.

Furthermore, the ice bank with ice stored therein is accommodated in the additional installation space separated from the storage space. Therefore, a phenomenon that ice stored in the ice bank is impregnated with odor of other foods stored in the storage space is minimized, and thus, the ice can be stored in a more sanitary way.

Moreover, the tray cover prevents water from being splashed out of the ice tray when the water is supplied to the ice tray. Therefore, the contamination of the interior of the refrigerator due to the water can be minimized in the process of making ice, and thus, the refrigerator can be utilized more cleanly.

BEST MODE

Hereinafter, a preferred embodiment of an ice-making device for a refrigerator according to the present invention will be described in detail with reference to the accompanying drawings.

Figure 1:
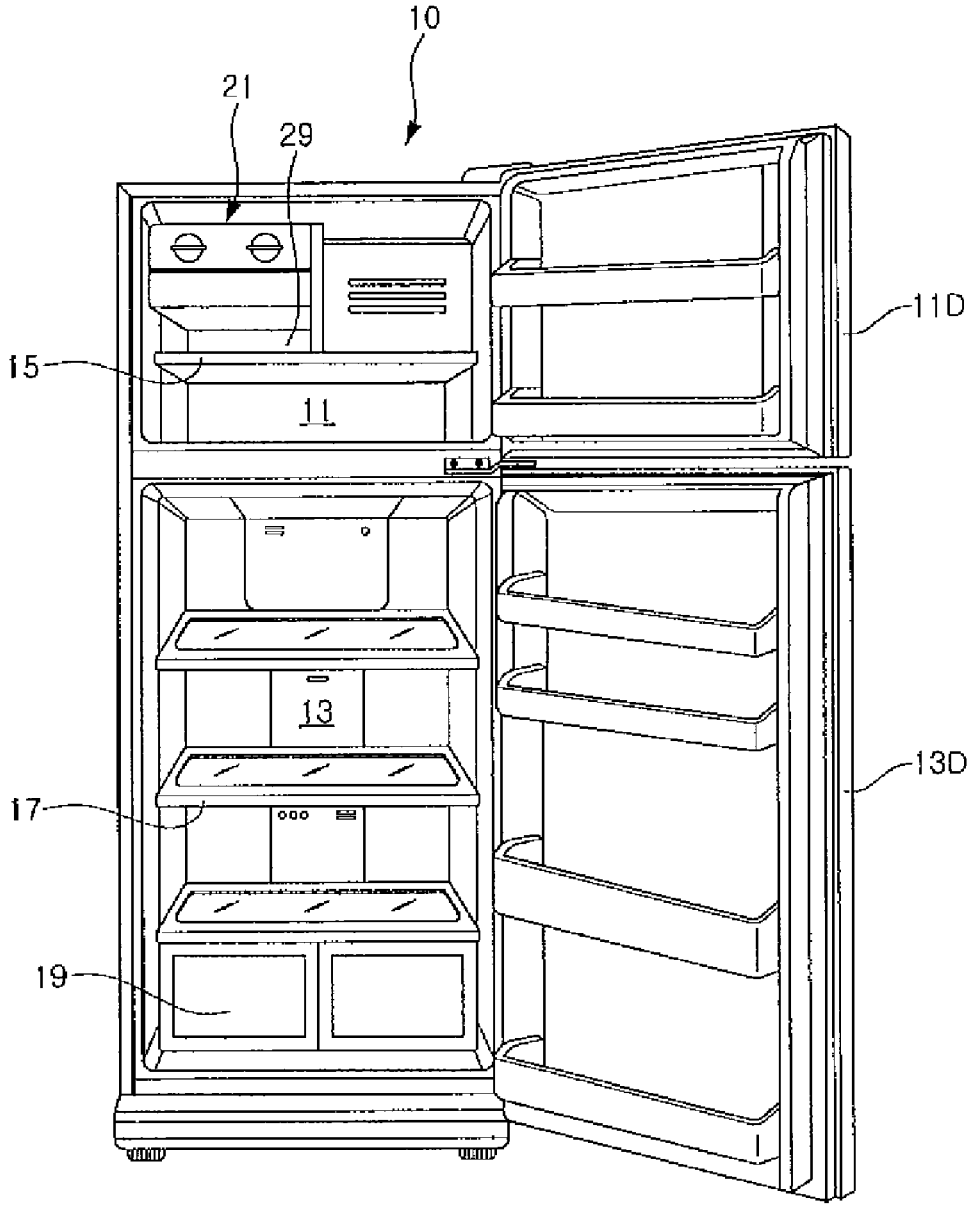
FIG. 1 is a front view showing the interior of a refrigerator equipped with a conventional ice-making device.
Figure 2:
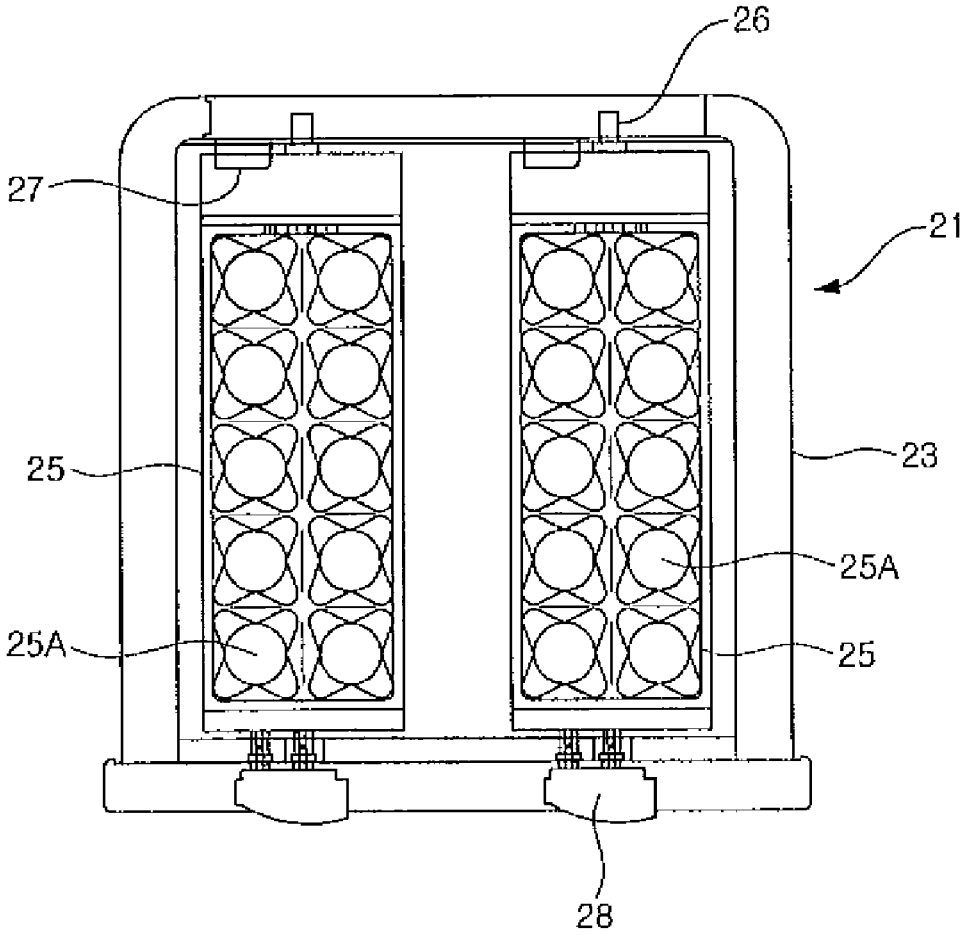
FIG. 2 is a front view of the ice-making device provided in the refrigerator shown in FIG. 1.
Figure 3:
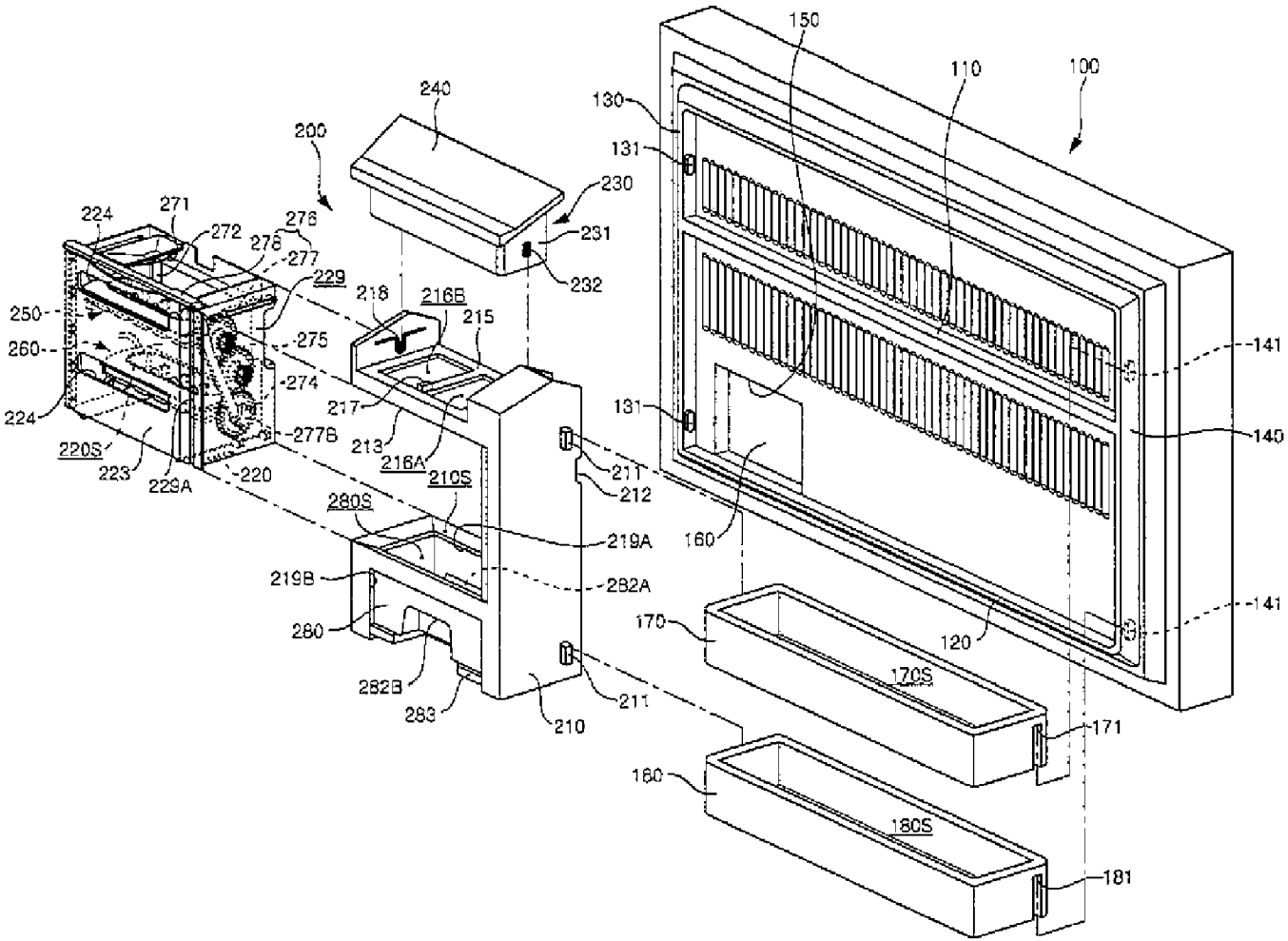
FIG. 3 is an exploded perspective view of an embodiment of an ice-making device for a refrigerator according to the present invention.
Figure 4:
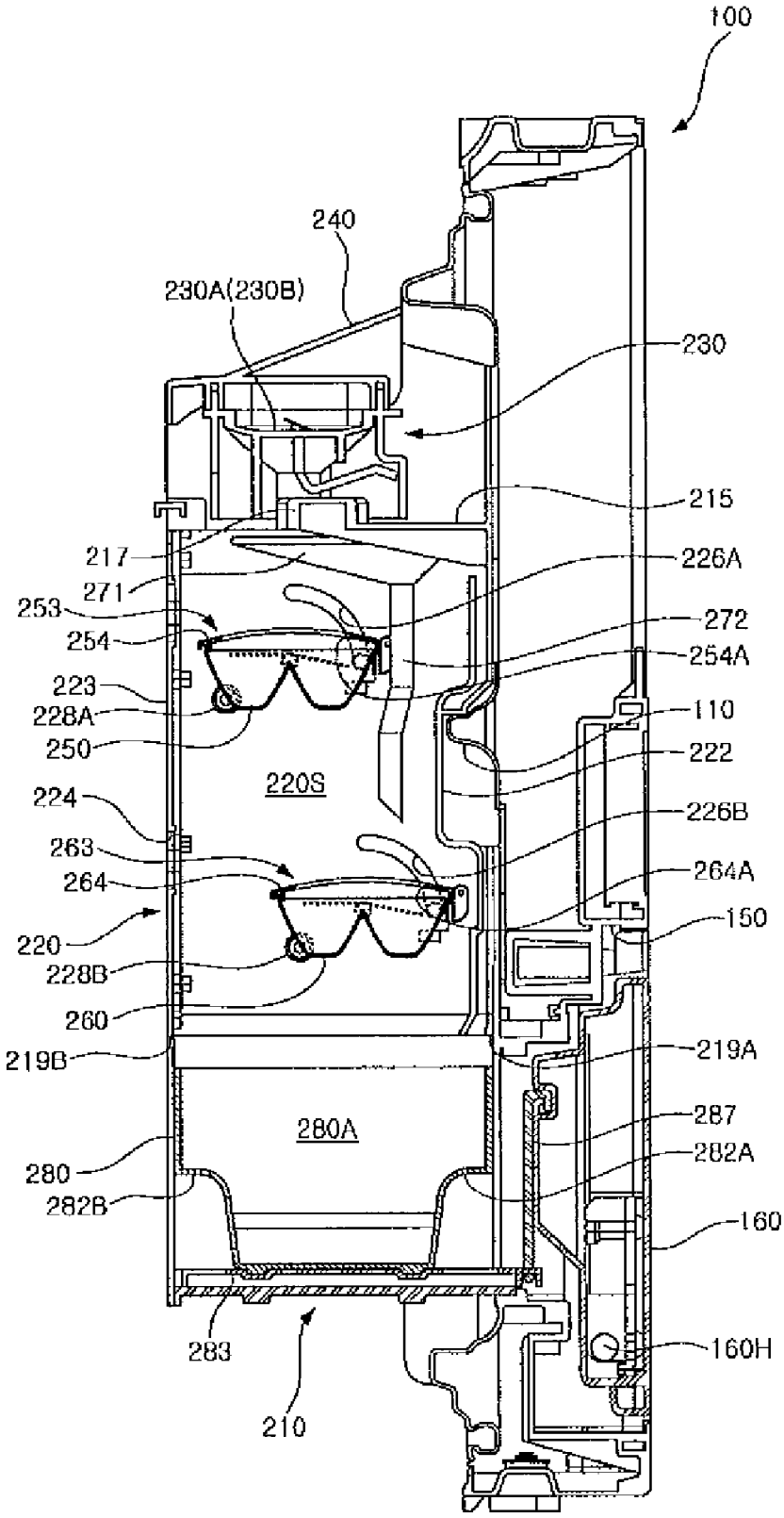
FIG. 4 is a side sectional view showing the embodiment shown in FIG. 3.
Figure 5:
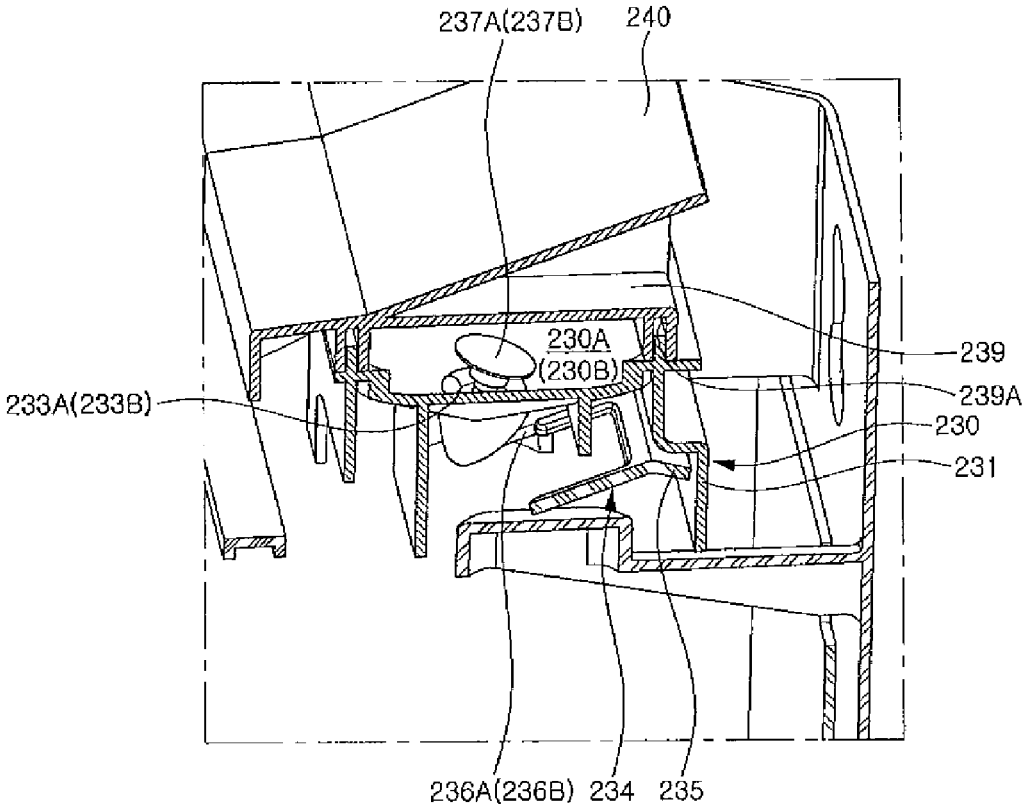
FIG. 5 is a partial cut-away perspective view showing in detail a state where a water tank of the embodiment shown in FIG. 3 is mounted to an ice-making housing.
Figure 6:
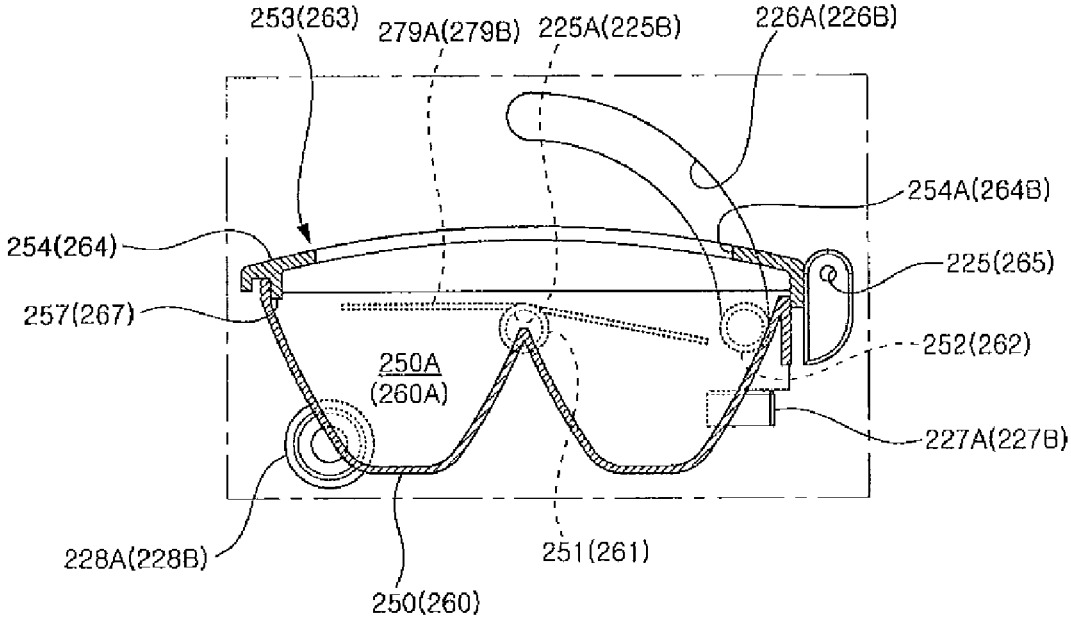
FIG. 6 is a side sectional view showing in detail a state where an ice tray of the embodiment shown in FIG. 3 is mounted to the ice-making housing.
Figure 7:
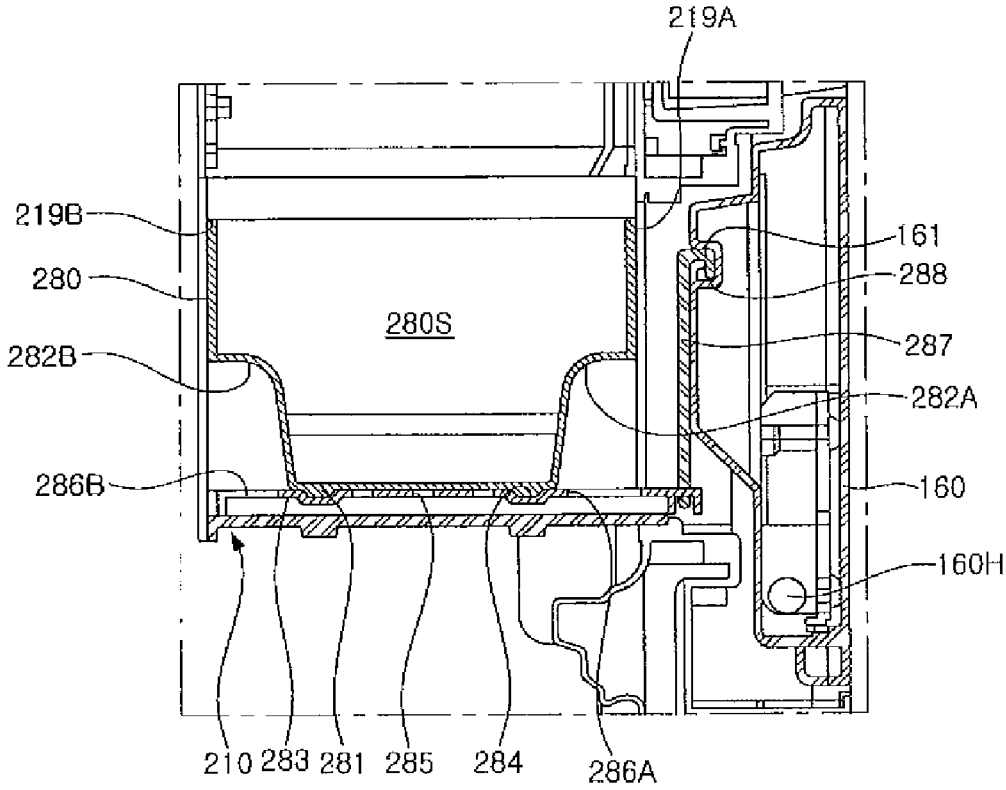
FIG. 7 is a side sectional view showing in detail a state where an ice bank of the embodiment shown in FIG. 3 is accommodated in the ice-making housing.

FIG. 3 is an exploded perspective view of the preferred embodiment of an ice-making device for a refrigerator according to the present invention; FIG. 4 is a side sectional view showing the embodiment shown in FIG. 3; FIG. 5 is a partial cut-away perspective view showing in detail a state where a water tank of the embodiment shown in FIG. 3 is mounted to an ice-making housing; FIG. 6 is a side sectional view showing in detail a state where an ice tray of the embodiment shown in FIG. 3 is mounted to the ice-making housing; and FIG. 7 is a side sectional view showing in detail a state where an ice bank of the embodiment shown in FIG. 3 is accommodated in the ice-making housing.

As shown in the figures, a pair of seating steps 110 and 120 and ridged portions 130 and 140 are provided on a rear surface of a refrigerator door 100. The seating steps 110 and 120 are provided at the center and a lower end on the rear surface of the door 100 in a horizontal direction. Further, the ridged portions 130 and 140 are provided at both side ends of the rear surface of the door 100 in a vertical direction.

Door baskets 170 and 180 or ice-making housings 210 and 220, which will be explained later, are securely placed on upper surfaces of the seating steps 110 and 120, respectively. A plurality of mounting protrusions 131 and 141 are provided on opposite surfaces of the ridged portions 130 and 140, respectively. The mounting protrusions 131 and 141 of the ridged portions 130 and 140 are fitted into mounting grooves 171 and 181 of the door baskets 170 and 180 or mounting grooves of the ice-making housings 220.

An opening 150 is provided at a position on the door 100. The opening 150 is used to take the ice bank 280, which will be explained later, out of the refrigerator without opening the door 100. Further, a home bar door 160 is provided to selectively open or close the opening 150. The home bar door 160 is installed on the door 100 such that it is pivoted on a hinge shaft 160H provided at a lower end of the door 100.

As shown in detail in FIG. 7, a cooperating groove 161 is formed on the rear surface of the home bar door 160. The cooperating groove 161 is formed on the rear surface of the home bar door 160 along a horizontal line spaced apart downwardly from an upper end of the home bar door 160 by a predetermined distance. A cooperating rib 288 of a cooperating plate 287, which will be explained later, is inserted into the cooperating groove 161.

A pair of the door baskets 170 and 180 are provided on the rear surface of the door 100. Predetermined receiving spaces 170S and 180S are defined in the door baskets 170 and 180, respectively. The door baskets 170 and 180 are detachably installed to the rear surface of the door 100. To this end, the downwardly open mounting grooves 171 and 181 are formed on both external lateral surfaces of the door baskets 170 and 180, respectively. The mounting protrusions 141 of the ridged portions 130 and 140 are fitted into the mounting grooves 171 and 181 positioned at the right side of the door baskets 170 and 180 as viewed in FIG. 3. Mounting protrusions 211 of the ice-making housing 210 are fitted into the mounting grooves 171 and 181 positioned at the left side of the door baskets 170 and 180 as viewed in FIG. 3.

An ice-making device 200 is provided on the rear surface of the door 100. The ice-making device 200 is detachably installed to the rear surface of the door 100. The ice-making device 200 comprises the ice-making housings 210 and 220, a water tank 230, ice trays 250 and 260, and the ice bank 280.

The ice-making housings 210 and 220 substantially define an external appearance of the ice-making device 200. The water tank 230, the ice trays 250 and 260, and the ice bank 280 are installed in the ice-making housings 210 and 220. The ice-making housings 210 and 220 are divided into the first ice-making housing 210 and the second ice-making housing 220.

The first ice-making housing 210 is formed in a hexahedral shape with an open top. A first installation space 210S is defined within the first ice-making housing 210. A plurality of the mounting protrusions 211 are provided at the right side of the first ice-making housing 210 as viewed in FIG. 3. The mounting protrusions 211 of the first ice-making housing 210 are fitted into the mounting grooves 171 and 181 of the door baskets 170 and 180, respectively.

A cutout 212 is provided at the right side of the first ice-making housing 210. The cutout 212 is formed by cutting away a portion of the right side of the ice-making housing 210 in the form of a shape corresponding to a cross section of the seating step 110 provided at the center of the rear surface of the door 100.

A housing entrance 213 is provided at the first ice-making housing 210. The housing entrance 213 is formed by cutting front and rear sides and a portion of the center of a left side off the first ice-making housing 210 in correspondence with the shape and size of those of the second ice-making housing 220. The housing entrance 213 serves as an entrance through which the second ice-making housing 220 is installed in and detached from the first installation space 210S.

A water tank seating portion 215 is provided at an upper portion of the first installation spaced 210S spaced downwardly from an upper end of the first ice-making housing 210 by a predetermined distance. The water tank seating portion 215 is a portion where the water tank 230 is securely placed. The water tank seating portion 215 is provided with a pair of water supply ports 216A and 216B which are divided in a right or left direction. The right water supply port of the water tank seating portion 215 is referred to as the first water supply port 216A and the lest water supply port of the water tank seating portion 2155 is referred to as the second water supply port 216B, as viewed in the figure. An actuating protrusion 217 is provided on the center of a top surface of the water tank seating portion 215, i.e. between the first and second water supply ports 216A and 216B. The actuating protrusion 217 serves to actuate a valve assembly 234 provided in the water tank 230.

Seating grooves 218 are provided on inner side surfaces of the first ice-making housing 210 positioned above the water tank seating portion 215, respectively. The seating grooves 218 is upwardly open, and a seating protrusion 232 formed on the water tank 230 is securely placed in each of the seating grooves 218.

Ice bank entrances 219A and 219B are provided at lower portions of the rear and front surfaces of the first ice-making housing 210. The ice bank entrances 219A and 219B are entrances through which the ice bank 280 is received in or withdrawn out of the first installation space 210S. Hereinafter, the entrance formed at the rear lower surface of the first ice-making housing 210 is referred to as the first ice bank entrance 219A and the entrance formed at the front lower surface of the first ice-making housing 210 is referred to as the second ice bank entrance 219B.

The second ice-making housing 220 is formed in a hexahedral shape with open top and bottom. A second installation space 220S is defined within the second ice-making housing 220. A plurality of mounting grooves (not shown) are formed on a left surface of the second ice-making housing 220 as viewed in FIG. 3. The mounting grooves are downwardly open. The mounting protrusions 131 and 141 of the ridged portions 130 and 140 are fitted in the mounting grooves of the second ice-making housing 220, respectively.

The second ice-making housing 220 is detachably installed in the first installation space 210S through the housing entrance 213. A recess 222 is provided on a rear surface of the second ice-making housing 220. The recess 222 is formed by depressing a portion of the rear surface of the second ice-making housing 220, which corresponds to the rear surface of the first ice-making housing 210, toward the second installation space 220S by a predetermined depth in a right or left direction in correspondence with a cross section of the cutout 212. The seating step 110 provided at the center of the rear surface of the door 100 is inserted in the recess 222.

A viewing window 223 is provided on a front surface of the second ice-making housing 220 in parallel with the rear surface of the second ice-making housing 220. The viewing window 223 is used to visually check the interior of the second installation space 220S. The viewing window 223 is provided with a pair of cold air supply ports 224. Each of the cold air supply ports 224 is formed by cutting out a portion of the viewing window 223 in a right or left direction. The cold air supply ports 224 are used to allow the cold air circulating in the storage space closed by the door 100 to be supplied into the second installation space 220S and substantially into the ice trays 250 and 260.

As shown in FIG. 6, a pair of holes for rotation 225A and 225A are provided on each of both side surfaces of the second ice-making housing 220. The holes for rotation 225A and 225B are used to rotatably support the ice trays 250 and 260, respectively. A pair of guide slots 226A and 226B are formed on one side surface of the second ice-making housing 220, i.e. the left side surface as viewed in FIG. 3, adjacent to the holes for rotation 225A and 225B. The guide slots 226A and 226B are formed into an arc shape having a predetermined central angle about the holes for rotation 225A and 225B. In the illustrated embodiment, the guide slots 226A and 226B are formed into an arc shape having a central angle of approximately 0 to 100 degrees around the holes for rotation 225A and 225B at a Cartesian coordinate, as viewed in the second installation space 220S toward one inner side surface of the second ice-making housing 220.

A pair of tray stoppers 227A and 227B are provided on one inner side surface of the second ice-making housing 220 adjacent to the holes for rotation 225A and 225B. The tray stoppers 227A and 227B serve to maintain the ice trays 250 and 260 at a horizontal state and also to come into close contact with the ice trays 250 and 260, which have been rotated by a certain angle, so that the ice trays 250 and 260 can be twisted.

Further, a pair of guide stoppers 228A and 228B are provided on one inner side surface of the second ice-making housing 220 at positions opposite to the tray stoppers 227A and 227B with respect to the holes for rotation 225A and 225B. The guide stoppers 228A and 228B serve to cause tray covers 253 and 263, which will be explained later, to be pivoted relatively on the ice trays 250 and 260. To this end, the guide stoppers 228A and 228B are brought into close contact with the tray covers 253 and 263. This will be further described below in detail.

Referring again to FIG. 3, a gear installation unit 229 is provided in the second ice-making housing 220 adjacent to the second installation space 220S. The gear installation unit 229 is a region where a plurality of gears for rotating the ice trays 250 and 260 are installed. For example, if the second ice-making housing 220 is composed of outer and inner housings which are brought into close contact with each other at one side thereof but are spaced apart from each other at the other side thereof, the gear installation unit may be defined between an inner side of the outer housing and an outer side of the inner housing.

A lever slot 229A is provided at a right end of the front end of the second ice-making housing 220 as viewed in the figure. The lever slot 229A is used to guide the movement of a lever 276 (which will be described below) for rotating the ice trays 250 and 260. The lever slot 229A is formed in a vertical direction at the right end of the front surface of the second ice-making housing 220 to communicate with the gear installation unit 229.

Further, the water tank 230 is detachably installed to the upper portion of the first installation space 210S. A water storage space is defined within the water tank 230, as shown in detail in FIG. 5. The water storage space is composed of first and second water storage spaces 230A and 230B which are divided in a right or left direction. Water which will be supplied to the ice trays 250 and 260, i.e. the first and second ice trays 250 and 260, may be stored in the first and second water storage spaces 230A and 230B, respectively. The water stored in the first water storage space 230A is supplied to the first ice tray 250 through the first water supply port 216A. The water stored in the second water storage space 230B is supplied to the second ice tray 260 through the second water supply port 216B, a water supply hopper 271, which will be explained later, and a water supply tube 272.

The water tank 230 comprises a tank main body 231 in which the first and second water storage spaces 230A and 230B are defined, a tank cover 239 for selectively opening or closing the top of the tank main body 231, and a valve assembly 234 for selectively supplying the ice trays 250 and 260 with water stored in the first and second water storage spaces 230A and 230B.

The tank main body 231 is formed into a hexahedral shape with open top and bottom. The seating protrusions 232 which are securely placed in the seating grooves 218 are formed on both outer side surfaces of the tank main body 231, respectively. Each of the first and second water storage spaces 230A and 230B is formed in the tank main body 231 in the shape of a hopper symmetrical in a right or left direction. Further, first and second water supply ports 233A and 233B are formed on the bottoms of the first and second water storage spaces 230A and 230B, respectively.

The valve assembly 234 comprises a valve main body 235 which is installed below the tank main body 231 such that one end thereof can be vertically pivoted on the other end, and an elastic member (not shown) for imparting an elastic force upwardly to the valve main body 235. The valve main body 235 is configured in such a manner that the actuating protrusion 217 is actuated to allow one end of the valve main body 235 to be pivoted upwardly about the other end when the water tank 230 is mounted to the top of the first installation space 210S. The pivoting end of the valve main body 235 is provided with a valve protrusion 236A or 236B that moves in a vertical direction through the first or second water supply port 233A or 233B. A valve cover 237A or 237B for selectively opening or closing the first or second water supply port 233A or 233B by means of the movement of the valve protrusion 236A or 236B is provided at an upper end of the valve protrusion 236A or 236B. The elastic member imparts an elastic force to the valve main body 235 such that one end of the valve main body 235 is pivoted downwardly about the other end thereof. Therefore, if the force required to upwardly pivot the valve main body 235 is removed, i.e. the water tank 230 is detached from the top of the first installation space 210S, the valve main body 235 is downwardly pivoted to allow the valve cover 237A or 237B to close the first or second water supply port 233A or 233B. As an elastic member, a torsion spring may be utilized which is provided at a pivoting center to allow both ends thereof to be fixed respectively to the tank main body 231 and the valve main body 235.

The tank cover 239 selectively opens or closes the open top of the tank main body 231. The tank cover 239 is formed in a shape corresponding to the top of the tank main body 231. A groove 239A where an upper edge of the tank main body 231 is inserted and fixed is formed at the periphery of a lower surface of the tank cover 239.

Further, a housing cover 240 is formed on a top surface of the tank cover 239. The tank cover 240 serves to closes the first installation space 210S. In this illustrated embodiment, the housing cover 240 is integrally formed with the tank cover 239, but the present invention is not limited thereto. For example, the housing cover 240 is formed separately from the tank cover 239, and thus, it may be detachably installed to the first ice-making housing 210 or the tank cover 239.

Referring again to FIG. 3, the ice trays 250 and 260 are composed of the first and second ice trays 250 and 260 which are rotatably installed in the second installation space 220S. Hereinafter, the ice tray installed to a relatively upper portion of the second installation space 220S is referred to as the first ice tray 250 and the ice tray installed to a relatively lower portion of the second installation space 220S is referred to as the second ice tray 260.

As shown in FIG. 6, each of the first and second ice trays 250 and 260 has a rectangular cross section. A plurality of ice-making grooves 250A or 260A in which ice is substantially made are formed in the first or second ice tray 250 or 260. Then, the first and second ice trays 250 and 260 are twisted in order to separate the made ice from the ice-making grooves 250A and 260A. That is, the first and second ice trays 250 and 260 are twisted in such a manner that they are rotated about rotating shafts 251 or 261 provided on their opposite short sides by predetermined angles are then caught to the tray stoppers 227A and 227B, respectively. The rotating shafts 251 and 261 are rotatably inserted in the holes for rotations 225A and 225B, respectively.

Each of guide protrusions 252 and 262 is provided on one surface of the first or second ice tray 250 or 260 adjacent to the rotating shaft 251 or 261. The guide protrusions 252 and 262 are inserted in the guide slots 226A and 226B, respectively. The guide protrusion 252 or 262 is guided along the guide slot 226A or 226B when the ice tray 250 or 260 is rotated. At this time, the guide protrusion 252 or 262 is placed on one end of the guide slot 226A or 226B corresponding to a position where it is rotated about the hole for rotation 225A or 225B by an angle of zero degree, when the first or second ice tray 252 or 262 is in a horizontal state, i.e. when the first or second ice tray 250 or 260 is supported by the tray stopper 227A or 227B. The guide protrusion 252 or 262 is guided along the guide slot 226A or 226B when the first or second ice tray 250 or 260 is rotated. Then, the guide protrusion 252 or 262 is placed on the other end of the guide slot 226A or 226B corresponding to a position where it is rotated about the hole for rotation 225A or 225B by an angle of 100 degrees, when the first or second ice tray has been twisted by the tray stopper 227A or 227B.

The first or second ice tray 250 or 260 is provided with the first or second tray cover 253 or 263 which is pivoted in harmony with the ice tray. The tray cover 253 or 263 serves to prevent water supplied in the first or second ice tray 250 or 260 from being splashed to the outside of the ice tray, i.e. into the second installation space 220S.

Further, the tray cover 253 or 263 is composed of a tray cover main body 254 or 264 and a contacting rib 257 or 167. The tray main body 254 or 264 is provided with a water supply port 254A or 264A at the center thereof. Through the water supply port 254A or 264A, water stored in the first or second water storage space 230A or 230B is fed into the first or second ice tray 250 or 260. Thus, the water supply port 254A or 264A is preferably formed in the tray main body 254 or 264 to have such a shape and size that the first or second water supply port 216A or 216B is included in a cross section of the water supply port 254A or 164A. The tray main body 254 or 264 is provided with a pivot shaft 255 or 265 at a rear end thereof. The pivot shaft 254 or 264 becomes a pivot center of the first or second tray cover 253 or 263 which is relatively pivoted with respect to the first or second ice tray 250 or 260. The contact rib 257 or 267 extends downwardly from an outer periphery on a lower surface of the tray main body 254 or 264. A leading end of the contact rib 257 or 267 is brought into close contact with an upper inner end of the first or second ice tray 250 or 260.

As described above, the first or second tray cover 253 or 263 is installed to the first or second ice tray 250 or 260 such that a front end of the tray cover is vertically pivoted on the pivot shaft 255 or 265. A front end of the first or second tray cover 253 or 263 is brought into close contact with the tray stopper 227A or 227B when the first or second ice tray 250 or 260 is in a horizontal state. Thus, the front end of the first or second tray cover 253 or 263 is relatively rotated about the pivot shaft 255 or 265 with respect to the first or second ice tray 250 or 260 in a direction opposite to a rotating direction of the first or second ice tray 250 or 260 when the ice tray is rotated. That is, if the first or second ice tray 250 or 260 is rotated counterclockwise as viewed in FIG. 4 such that ice can be separated from the ice-making grooves 250A or 260A, the first or second tray cover 253 or 263 is relatively rotated about the pivot shaft 255 or 265 with respect to the first or second ice tray 250 or 260 in a state where the front end of tray cover is brought into close contact with the guide stopper 228A or 228B.

Referring again to FIG. 3, the water supply hopper 271 is provided at the upper portion of the second installation space 220S. The water supply hopper 271 is used to supply the ice trays 250 and 260 with water stored in the second water storage space 230B. The water supply hopper 271 is formed into a hopper shape with an open top. Further, the water supply hopper 271 is provided at an upper right side of the second installation space 220S such that the open top thereof is positioned just below the second water supply port 216B.

The water supply tube 272 is connected to a lower portion of the water supply hopper 271. The water supply tube 272 is used to transfer water, which ha been supplied from the second water storage space 230B to the water supply hopper 271, substantially to the ice-making grooves 250A and 260A of the second ice tray 260. To this end, an end of the water supply tube 272 is connected to the lower portion of the water supply hopper 271. The other end of the water supply tube 272 is positioned at an upper portion of the second ice-making housing 220. The water supply tube 272 is made of a flexible material. The reason is that the rotation of the first or second ice tray 250 or 260 is not hindered by the water supply tube 272.

Figure 8:
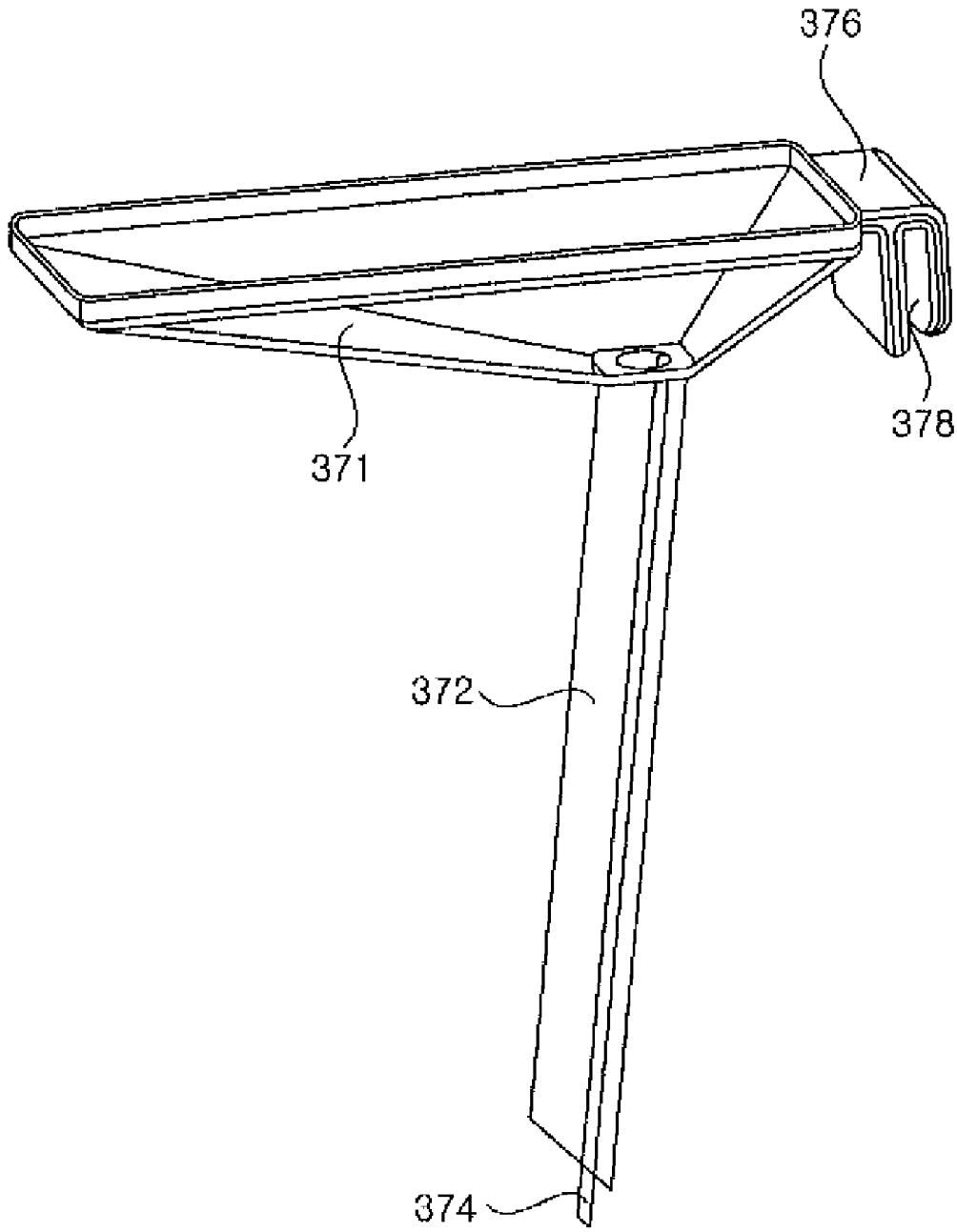
FIG. 8 is a perspective view showing an example of a water supply means of the embodiment shown in FIG. 3.

FIG. 8 is a perspective view showing another example of a water supply means constituting the embodiment shown in FIG. 3. Referring to FIG. 8, a water supply hopper 371 is provided at the upper portion of the second installation space 220S. The water supply hopper 371 is used to supply the ice trays 250 and 260 with water stored in the second water storage space 230B. The water supply hopper 371 is formed into a hopper shape with an open top.

Further, a water supply tube 372 is connected to a lower portion of the water supply hopper 371. The water supply tube 372 is inclined relative to the water supply hopper 371 such that water can run down the water supply tube 372. The water supply tube 372 is formed such that its distal end is inclined at an acute angle (θ) relative to an extension direction of the water supply tube 372. An end guide 374 protruding from the distal end of the water supply tube 372 is formed at the distal end of the tube. Since the distal end of the water supply tube 372 is inclined at a predetermined angle, the flow of water is guided into the end guide 374 such that the water cannot be splashed at the distal end of the water supply tube 372.

A mount 376 is provided at a side of the water supply hopper 371. The mount 376 is mounted to the second ice-making housing 220. The mount 376 is formed with a mounting groove 378 such that the water supply hopper 371 can be moved in a right or left direction in a state where the hopper is mounted to the second ice-making housing 220.

The gear installation unit 229 is provided with first and second gears 273 and 274, a linking gear 275, and the lever 276 to allow the first and second ice trays 250 and 260 to be simultaneously rotated. The first gear 273 is connected to the rotating shaft 251 provided on the right surface of the first ice tray 250 as viewed in the figure. The second gear 274 is also connected to the rotating shaft 261 provided on the right surface of the first ice tray 260 as viewed in the figure. The linking gear 275 is engaged with the first and second gears 273 and 274. Therefore, since the first and second gears 273 and 274 are simultaneously rotated by the linking gear 275, the first and second ice trays 273 and 274 can be simultaneously rotated.

The lever 276 is composed of a connection portion 277 and a grip portion 278. The connection portion 277 is formed into a bar shape extending in a longitudinal direction. One end of the connection portion 277 is formed with a connection boss 277B which is connected to the second gear 274. The other end of the connection portion 277 passes through the lever slot 229A and then extends to the outside of the gear installation unit 229. The grip portion 278 is connected perpendicularly to the other end of the connection portion 277 extending to the outside of the gear installation unit. The grip portion 278 is a portion which a user substantially grips to rotate the first and second gears 273 and 274.

A torsion spring 279A or 279B is provided at any one of the pivot shafts 251 and 261 of the first and second ice trays 250 and 260 (refer to FIG. 6). Both ends of the torsion spring 279A or 279B are fixed to an inner side of the second ice-making housing 220 and one side of the first or second ice tray 250 or 260, respectively. The torsion spring 279A or 279B is used to provide the first or second ice tray 250 or 260 with an elastic force in a direction opposite to a direction in which the first or second ice tray 250 or 260 is pivoted to separate ice from the ice-making grooves 250A or 260A.

As shown in FIG. 7, the ice bank 280 is provided with an ice storage space 280S in which ice made in the first and second ice trays 250 and 260 is stored. The ice bank 280 is installed at a lower portion of the first installation space 2105 such that it can be received in or withdrawn out of the first installation space 210S through the first and second entrances 219A and 219B.

That is, when the storage space is closed by the door 100, the ice bank 280 is received in or withdrawn out of the first installation space 210S through the opening 150 opened by the first ice bank entrance 219A and the home bar door 160. When the door 100 is opened, the ice bank 280 is received in or withdrawn out of the first installation space 210S through the second ice bank entrance 219B.

At least one movement prevention protrusion 281 is provided on a bottom surface of the ice bank 280. The movement prevention protrusion 281 is used to prevent the ice bank 280 from being inadvertently moved in a state where the ice bank is securely placed on a top surface of a seating plate 283, which will be explained later, while the ice bank is moved into or out of the first installation space 210S. To this end, the movement prevention protrusion 281 protrudes downwardly from the bottom surface of the ice bank 280 by a predetermined height such that it can be inserted in a movement prevention groove 284 formed on the seating plate 283.

Gripping recesses 282A and 282B are provided at lower front and rear ends of the ice bank 280, respectively. The gripping recesses 282A and 282B are portions which a user grips to allow the ice bank 280 to be received in or withdrawn out of the first installation space 210S through either the first ice bank entrance 219A and the opening 150 or the second ice bank entrance 219B. The gripping recess 282A or 282B is formed by causing a central portion of the lower front or rear end of the ice bank 280 to be depressed upwardly.

The ice bank 280 is installed such that it can be received in or withdrawn out of the first installation space 2108 in accordance with the rotation of the home bar door 160 for opening or closing the opening 150. To this end, the seating plate 283 is provided on a floor surface of the first installation space 210S. The seating plate 283 is installed to be movable into or out of the first installation space 210S. Movable rollers 283R for guiding the movement of the seating plate 283 are provided on rear ends on both lateral sides of the seating plate 283, respectively.

A plurality of the movement prevention grooves 284 in which the movement prevention protrusions 281 are inserted are formed on the seating plate 283. A plurality of water drain holes 285 are also formed in the seating plate 283. The drain holes 285 are used to allow the water residing between the bottom surface of the ice bank 280 and the top surface of the seating plate 283 to drain downwardly such that they cannot be frozen to each other.

Gripping openings 286A and 286B are provided at front and rear ends of the seating plate 283, respectively. The gripping opening 286A or 286B allows a user to easily grip the gripping recess 282A or 282B such that the ice bank 280 can be easily received or withdrawn. The gripping opening 286A or 286B is formed by cutting out a central portion of the front or rear end of the seating plate 283 to correspond to a cross section of the gripping recess 282A or 282B.

A rear end of the cooperating plate 287 is connected to a front end of the seating plate 283. The cooperating rib 288 is provided at a front end of the cooperating plate 287. The cooperating rib 288 is inserted in the cooperating groove 161. The cooperating plate 287 is moved forward or backward, i.e. in a direction in which the ice bank 280 is received in or withdrawn out of the first installation space 210S, as the home bar door 160 is pivoted to open or close the opening 150.

The pivot center of the cooperating plate 287, i.e. the rear end of the cooperating plate 287, is placed at a relatively higher position as compared with the pivot shaft 160H acting as the pivot center of the home bar door 160. Therefore, the cooperating rib 288 travels along a pivoting path with a shorter diameter as compared with the cooperating groove 161 as the home bar door 160 is pivoted. Accordingly, as the home bar door 160 is pivoted, the cooperating plate 287 is also pivoted to move in a horizontal direction.

Hereinafter, a process of making ice and withdrawing the made ice in the ice-making device for a refrigerator according to the preferred embodiment of the present invention will be described in detail with reference to the accompanying drawings.

Figure 9:
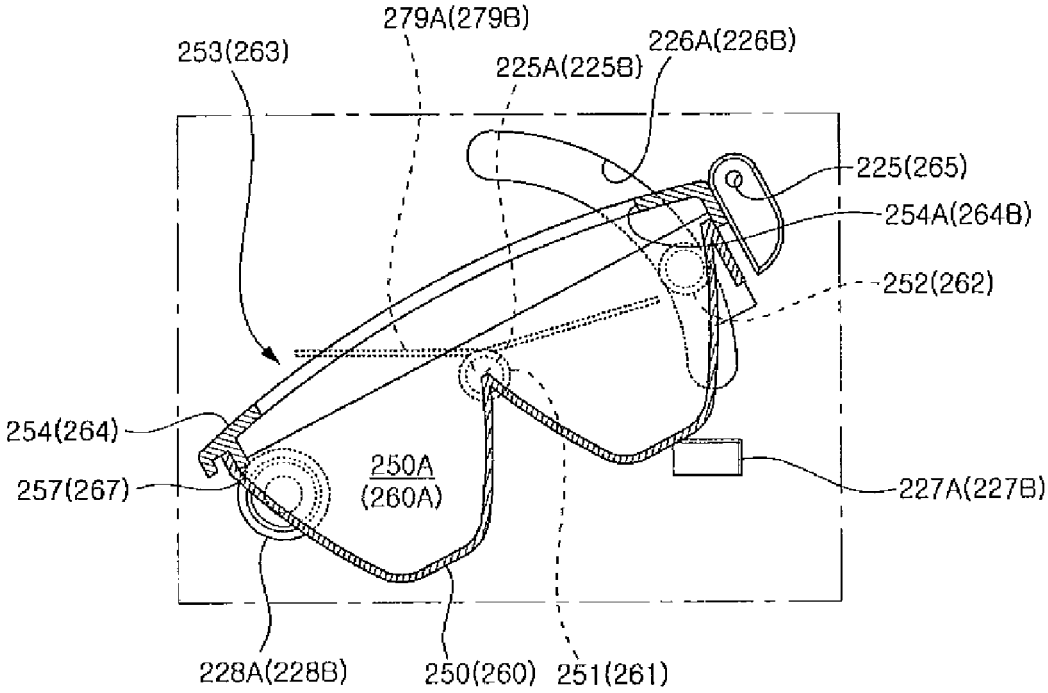
FIGS. 9 and 10 are views illustrating a process in which the ice tray of the embodiment shown in FIG. 3 is pivoted.
Figure 10:
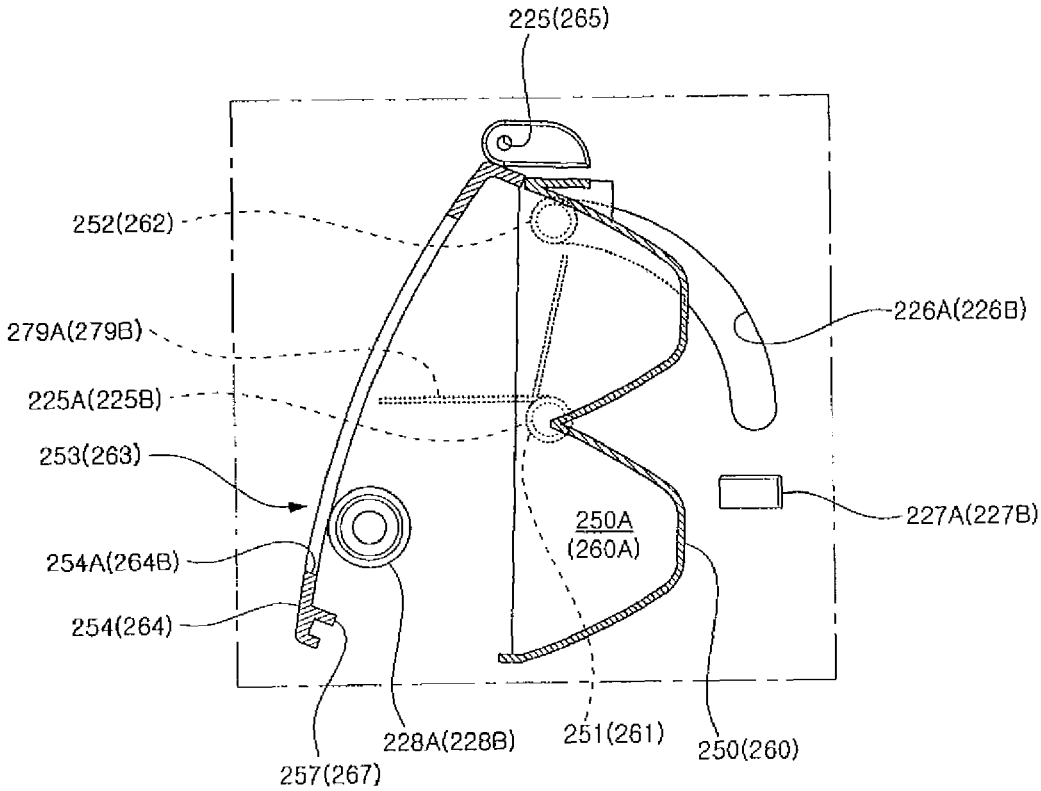
Figure 11:
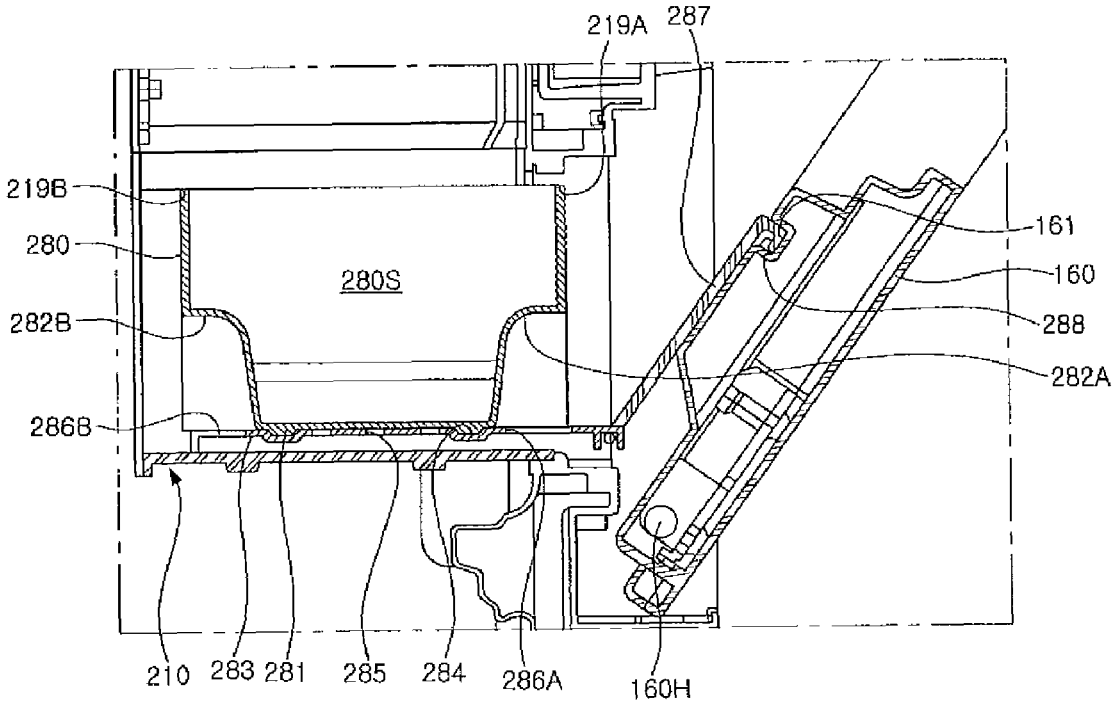
FIGS. 11 and 12 are views illustrating a process in which the ice bank of the embodiment shown in FIG. 3 is withdrawn.
Figure 12:
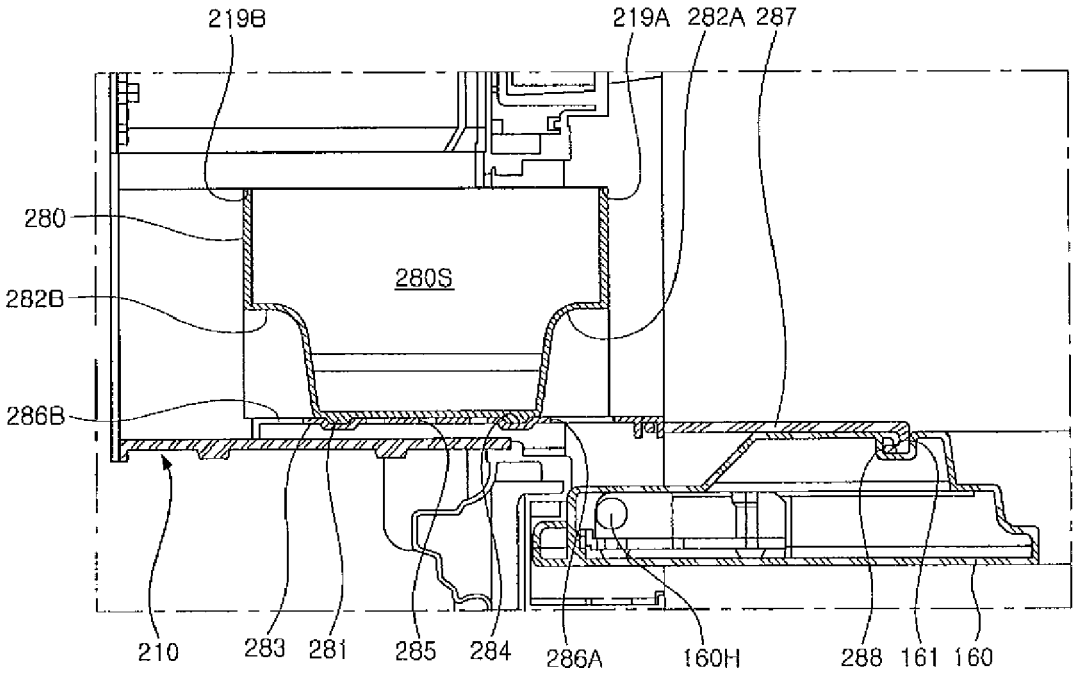

FIGS. 9 and 10 are views illustrating a process in of pivoting the ice tray of the ice-making device for a refrigerator according to the embodiment of the present invention, and FIGS. 11 and 12 are views illustrating a process of withdrawing the ice bank of the ice-making device for a refrigerator according to the embodiment of the present invention.

First, the water tank 230 with water stored in the first and second water storage spaces 230A and 230B is mounted to the first ice-making housing 210, i.e. on the first installation space 210S. At this time, the water tank 230 is mounted at the upper portion of the first installation space 210S from above. If the water tank 230 is mounted at the upper portion of the first installation space 210S, an outer periphery of a bottom surface of the water tank 230 is supported by the top surface of the water tank seating portion 215. The seating protrusion 232 of the water tank 230 is securely placed in the seating groove 218 of the first ice-making housing 210. Simultaneously, the first installation space 210S is closed by the housing cover 240 provided in the water tank 230. In the meantime, the valve assembly 234 of the water tank 230 is actuated by means of the actuating protrusion 217 of the first ice-making housing 210 and the first and second water supply ports 233A and 233B are then opened. Thus, water stored in the first water storage space 230A is supplied to the first ice tray 250 through the first water supply port 216A. Further, water stored in the second water storage space 230B is supplied to the second ice tray 260 through the second water supply port 216B, the water supply hopper 271 and the water supply tube 272.

As shown in FIG. 9, water supplied into the first or second ice tray 250 or 260 is not splashed to the outside, i.e. into the second installation space 220S, by means of the first or second tray cover 253 or 263. Further, the water supplied into the first or second ice tray 250 or 260 is frozen into ice by means of cold air supplied into the second installation space 220S through the cold air supply ports 224.

After the ice has been made in such a manner, a user twists the first or second ice tray 250 or 260 in order to separate the made ice from the first or second ice tray 250 or 260. That is, the lever 276 is pulled downwardly, the linking gear 275 and the first and second gears 273 and 274 engaged with the linking gear 275 are rotated counterclockwise as viewed in the figure. As shown in FIG. 10, therefore, the first or second ice tray 250 or 260 connected to the first or second gear 273 or 274 is also rotated about the rotating shaft 251 or 261 counterclockwise as viewed in the figure. At this time, the guide protrusion 252 or 262 is guided along the guide slot 226A or 226B in a state where it is positioned at an end of the guide slot 226A or 226B.

If the first or second ice tray 250 or 260 is rotated, the first or second tray cover 253 or 263 is relatively pivoted on the pivot shaft 255 or 265 with respect to the first or second ice tray 250 or 260, counterclockwise as viewed in the figure, in a state where a front end (a left end, as viewed in the figure) of the tray cover is brought into close contact with the guide stopper 228A or 228B. Therefore, a process of separating the ice from the first or second ice tray 250 or 260 is not hindered by the first or second tray cover 253 or 263.

If the first or second ice tray 250 or 260 is further rotated counterclockwise as viewed in the figure, one side of the first or second ice tray 250 or 260 is brought into close contact with the tray stopper 227A or 227B. If the lever 276 is further pulled downward in such a state, the first or second ice tray 250 or 260 is twisted. Thus, the made ice is separated from the first or second ice tray 250 or 260. Here, if a force required to pivot or twist the first or second ice tray 250 or 260, i.e. a force required to pull the lever 276 downwardly, is removed, the first or second ice tray 250 or 260 is restored into a state where it is horizontally placed, i.e. a state where one side of the ice tray is supported by the tray stopper 227A or 227B, by means of the elastic force of the torsion spring 279A or 279B.

The ice separated from the first or second ice tray 250 or 260 is stored in the ice bank 280. In order to take out the ice bank 280 with the ice stored therein, the home bar door 160 is first pivoted downwardly on the pivot shaft 160H to open the opening 150.

As shown in FIGS. 11 and 12, therefore, as the home bar door 160 is pivoted, the cooperating plate 287 is also pivoted such that the front end of the plate 287 is pivoted downwardly on the rear end thereof and thus the plate 287 is moved forward of the first installation space 210S, i.e. rightward as viewed in the figure. As the cooperating plate 287 is moved in such a manner, both the seating plate 283 and the ice bank 280 placed on the top surface thereof are also moved rightward as viewed in figure such that the ice bank 280 can be withdrawn out of the first installation space 210S through the first ice bank entrance 219A and the opening 215. At this time, the movement of the seating plate 283 is guided by the movable rollers 283R provided on the rear ends of the lateral sides of the seating plate 283.

If the ice bank 280 is withdrawn out of the first installation space 210S, a user grips the gripping recess 282A provided on the front end of the ice bank 280 and removes the ice bank 280 from the top surface of the seating plate 283. Then, the user can take out and use the ice stored in the ice bank 280.

Although not shown, in a state where the door 100 is opened, i.e. in a state where the storage space is opened, the ice bank 280 can be withdrawn through the second ice bank entrance 219B. In such a case, a user grips the gripping recess 282B, which is provided at the rear end of the ice bank 280, through the second ice bank entrance 219B and then detaches the ice bank 280 from the top surface of the seating plate 283, and finally withdraws the ice bank from the first installation space 210S through the second ice bank entrance 219B.

While the present invention has been illustrated and described in connection with the accompanying drawings and the preferred embodiments, the present invention is not limited thereto and is defined by the appended claims. Therefore, it will be understood by those skilled in the art that various modifications and changes can be made thereto without departing from the spirit and scope of the invention defined by the appended claims.

The invention claimed is:

1. An ice-making device for a refrigerator, comprising:

a water tank detachably installed to a rear surface of a refrigerator door for selectively opening or closing a storage space;

first and second ice trays rotatably installed to the rear surface of the door to make ice using water supplied from the water tank; and an ice bank installed to the rear surface of the door to store therein the ice made in the first and second ice trays, wherein the water tank is divided into first and second water storage spaces from which water is supplied to the first and second ice trays, respectively.

2. The ice-making device as claimed in claim 1, wherein the water stored in the first and second water storage spaces is supplied simultaneously to the first and second ice trays, respectively, by means of a valve assembly actuated when the water tank is mounted to the rear surface of the door.

3. The ice-making device as claimed in claim 2, further comprising a water supply means for supplying water stored in any one of the first and second water storage spaces into one of the first and second ice trays positioned relatively lower than the other of the first and second ice trays installed to the rear surface of the door such that the ice trays are spaced apart from each other by predetermined distances both in a horizontal direction and in a front or rear direction.

4. The ice-making device as claimed in claim 3, wherein the water supply means comprises:

a water supply hopper installed just below the water tank to receive water from any one of the first and second water storages spaces of the water tank; and a water supply tube including one end connected to a lower portion of the water supply hopper and the other end positioned just above the lower ice tray to allow the water supplied into the water supply hopper to be delivered to the lower ice tray.

5. The ice-making device as claimed in claim 4, wherein the water supply tube is formed of a flexible material.

6. The ice-making device as claimed in claim 1, wherein the water supply means comprises:

a water supply hopper installed just below the water tank to receive water from any one of the first and second water storages spaces of the water tank; and a water supply tube installed below a lower portion of the water supply hopper to supply water to the predetermined ice tray and formed with a protruding end guide.

7. The ice-making device as claimed in claim 6, wherein the water supply tube is formed such that its distal end is inclined at an acute angle relative to an extension direction of the water supply tube.

8. The ice-making device as claimed in claim 1, further comprising an ice-making housing installed to the rear surface of the door and provided with an installation space in which the water tank, the first and second ice trays and the ice bank are installed.

9. The ice-making device as claimed in claim 8, further comprising a housing cover for covering the installation space of the ice-making housing in a state where the water tank is installed at an upper portion of the installation space of the ice-making housing.

10. The ice-making device as claimed in claim 9, wherein the housing cover is formed integrally with a top surface of the water tank.

11. An ice-making device for a refrigerator, comprising:

a water tank detachably installed to a rear surface of a refrigerator door for selectively opening or closing a storage space;

first and second ice trays rotatably installed to the rear surface of the door to make ice using water supplied from the water tank; and a rotating means installed to the rear surface of the door to simultaneously rotate the first and second ice trays such that the first and second ice trays can be twisted to separate the made ice from the first and second ice trays, wherein the rotating means comprises:

a first gear connected with any one of a pair of rotating shafts for allowing the first ice tray to be rotatably supported on the rear surface of the door;

a second gear connected with any one of a pair of rotating shafts for allowing the second ice tray to be rotatably supported on the rear surface of the door;

at least one linking gear engaged with the first and second gears; and a lever fixed to the linking gear such that a user can grip the lever to rotate the first and second ice trays.

12. The ice-making device as claimed in claim 11, wherein the lever includes:

a connection portion having one end connected to any one of the first and second gears and the linking gear; and a grip portion connected to the other end of the connection portion such that the user can grip the grip portion to rotate the first and second ice trays.

13. The ice-making device as claimed in claim 12, wherein the rotating means further comprises an elastic member for allowing the first and second gears and the linking gear to impart an elastic force to the first or second ice tray in a direction opposite to a direction in which the first or second ice tray is rotated to separate ice from the tray.

14. The ice-making device as claimed in claim 11, wherein each of the first and second ice trays is formed to have a rectangular cross section and is rotated about rotating shafts provided at opposite side surfaces thereof.

15. The ice-making device as claimed in claim 14, wherein the first or second ice tray is maintained at a horizontal state by means of a tray stopper provided on the rear surface of the door and is twisted by a force required to pivot the first or second ice tray in a state where a portion of the ice tray is brought into close contact with the tray stopper after the tray has been rotated by a predetermined angle of rotation.

16. The ice-making device as claimed in claim 15, wherein a guide protrusion is provided on any one of the opposite surfaces of the first or second ice tray to be spaced apart from the rotating shaft by a predetermined distance, a guide slot is formed into an arc shape having a predetermined central angle about the rotating shaft of the first or second ice tray and is formed at the rear surface of the door to allow the guide protrusion to be inserted therein, and the guide protrusion is moved from one end of the guide slot to the other end of the slot as the first or second ice tray is rotated about the rotating shaft.

17. The ice-making device as claimed in claim 11, wherein the first or second ice tray further comprises a first or second tray cover for preventing water stored in the water tank from being splashed to the outside of the ice tray while the water is supplied into the first or second ice tray.

18. The ice-making device as claimed in claim 17, wherein the tray cover includes:

a tray cover main body formed into a rectangular shape corresponding to an upper surface of the ice tray and provided with a water supply port, through which water delivered from water tank is supplied into the ice tray, at the center thereof; and a guide rib extending downwardly from an outer periphery on a lower surface of the tray main body and having a leading end of the contact rib brought into close contact with an upper edge of the first or second ice tray.

19. The ice-making device as claimed in claim 18, wherein the tray cover is installed such that any one of both ends of the tray cover parallel to the rotating shaft, which allows the ice tray to be rotatably supported on the rear surface of the door, is pivoted on the other end of the tray cover in a direction opposite to a rotating direction of the ice tray as the ice tray is rotated to separate ice from the ice tray.

20. The ice-making device as claimed in claim 19, wherein the pivoting end of the ice tray cover is brought into close contact with the guide stopper provided on the rear surface of the door to allow the pivot end to be relatively pivoted on the other end of the tray cover with respect to the ice tray in a direction opposite to the rotating direction of the ice tray to separate the ice from the ice tray.

21. The ice-making device as claimed in claim 11, further comprising an ice-making housing installed to the rear surface of the door and provided with an installation space in which the water tank, the first and second ice trays, the rotating means and the first and second tray covers are installed.

22. An ice-making device for a refrigerator, comprising:

first and second ice trays rotatably installed to a rear surface of a refrigerator door for selectively opening or closing a storage space to make ice using supplied water; and an ice bank installed to be received in or withdrawn from an opening formed by cutting out a portion of a front surface of the door and to store therein the ice made in the ice trays, wherein the ice bank is installed to be received in or withdrawn from an installation space defined within the ice-making housing detachably installed to the rear surface of the door, and wherein the ice bank is received or withdrawn in a front direction of the door through the opening and a first ice bank entrance formed in a rear surface of the ice-making housing brought into close contact with the rear surface of the door and is received or withdrawn in a rear direction of the door through the a second ice bank entrance formed in a front surface of the ice-making housing parallel to the rear surface of the door.

23. The ice-making device as claimed in claim 22, further comprising a cooperating means for allowing the ice bank to be received in or withdrawn from the installation space of the ice-making housing in accordance with a pivot motion of a home bar door installed at a potion on a front surface of the door such that an upper end of the home bar door is vertically pivoted on a lower end of the home bar door to selectively open or close the opening.

24. The ice-making device as claimed in claim 23, wherein the cooperating means includes:

a seating plate installed to be movable in or out of the installation space of the ice-making housing to allow the ice bank to be securely placed thereon; and a cooperating plate formed with a rear end pivotally connected to a front end of the seating plate and a front end fixed to a rear surface of the home bar door such that the ice bank is received in or withdrawn from the installation space of the ice-making housing as the home bar door is pivoted.

25. The ice-making device as claimed in claim 24, wherein at least one movement prevention protrusion and at least one movement prevention groove are formed on a bottom surface of the ice bank and a top surface of the seating plate, respectively, such that the protrusion is inserted in the groove to prevent the protrusion and the groove from being inadvertently moved relative to each other in a state where the ice bank is securely placed on the top surface of the seating plate while the seating plate is moved in or out of the installation space.

26. The ice-making device as claimed in claim 25, wherein at least one water drain hole is formed in the seating plate to allow water residing between the bottom surface of the ice bank and the top surface of the seating plate to drain downwardly.

27. The ice-making device as claimed in claim 26, wherein each lateral side of the seating plate is provided with at least one movable roller which is moved along a floor surface of the ice-making housing while the seating plate is moved in or out of the installation space of the ice-making housing as the home bar door is pivoted.

28. The ice-making device as claimed in claim 27, wherein each of front and rear ends of the ice bank is provided with a gripping recess which a user grips to allow the ice bank to be received in or withdrawn from the ice-making housing.

29. The ice-making device as claimed in claim 28, wherein the gripping recess is formed by upwardly depressing a portion of the front or rear end of the ice bank, and a gripping opening is provided at a front or rear end of the seating plate by cutting out a portion of the seating plate to correspond to a cross section of the gripping recess such that a user can easily grip the gripping recess.

30. An ice-making device for a refrigerator, comprising:

an ice-making housing installed to a rear surface of a refrigerator door for selectively opening or closing a storage space and provided with a predetermined installation space;

a water tank detachably installed to the installation space of the ice-making housing;

first and second ice trays rotatably installed to the installation space of the ice-making housing to make ice using water supplied from the water tank;

an ice bank retractably installed in the installation space of the ice-making housing to store therein the ice made in the first and second ice trays; and a mounting means for detachably mounting the ice-making housing to the rear surface of the door, wherein the mounting means includes:

at least one mounting protrusion formed on an inner surface of a ridged portion extending vertically at and protruding rearward from a side end of the rear surface of the door;

at least one seating groove formed in one side surface of the ice-making housing to allow the mounting protrusion of the ridged portion to be fitted therein;

at least one mounting protrusion formed on the other side of the ice-making housing; and at least one mounting groove formed in one side surface of a door basket detachably installed to the rear surface of the door to allow the mounting protrusion of the ice-making housing to be fitted therein.

31. The ice-making device as claimed in claim 30, wherein the ice-making housing includes:

a first ice-making housing detachably installed to the rear surface of the door and provided with a first installation space in which the water tank and the ice bank are installed; and a second ice-making housing detachably installed in the first installation space of the first ice-making housing and provided with a second installation space in which the first and second ice trays and the rotating means are installed.

32. The ice-making device as claimed in claim 31, wherein the mounting protrusion fitted in the mounting groove of the door basket is provided on one side surface of the first ice-making housing, and the mounting groove in which the mounting protrusion of the ridged portion is fitted is provided on one side surface of the second ice-making housing.

33. The ice-making device as claimed in claim 32, wherein a recess in which a seating step that extends in a horizontal direction along the rear surface of the door and protrudes backward from the rear surface of the door to support the door basket is inserted is formed on a rear outer surface of the second ice-making housing.

34. The ice-making device as claimed in claim 33, wherein a viewing window for visually checking whether ice is made in the first and second ice trays and at least one cold air supply port for supplying the first and second ice trays with cold air circulating in the storage space are provided on one side of the second ice-making housing.

* * * * *